US010118748B2

(12) United States Patent
Sánchez López et al.

(10) Patent No.: US 10,118,748 B2
(45) Date of Patent: Nov. 6, 2018

(54) MIXING STOPPER

(71) Applicant: Microgaia Biotech, S.L., Espinardo (Murcia) (ES)

(72) Inventors: Cristobal Sánchez López, Murcia (ES); José Antonio Pascual Valero, Murcia (ES)

(73) Assignee: Microgaia Biotech, S.L., Espinardo (Murcia) (ES)

( * ) Notice: Subject to any disclaimer, the term of this patent is extended or adjusted under 35 U.S.C. 154(b) by 0 days.

(21) Appl. No.: 15/569,621

(22) PCT Filed: Apr. 27, 2015

(86) PCT No.: PCT/ES2015/070349
§ 371 (c)(1),
(2) Date: Oct. 26, 2017

(87) PCT Pub. No.: WO2016/174275
PCT Pub. Date: Nov. 3, 2016

(65) Prior Publication Data

US 2018/0118428 A1 May 3, 2018

(51) Int. Cl.
*B65D 25/08* (2006.01)
*B65D 51/28* (2006.01)
*B65D 39/08* (2006.01)

(52) U.S. Cl.
CPC ..... *B65D 51/2878* (2013.01); *B65D 39/08* (2013.01); *B65D 51/2857* (2013.01); *B65D 51/2864* (2013.01)

(58) Field of Classification Search
CPC ..... B65D 39/08; B65D 51/2878; B65D 51/2864; B65D 51/2835
USPC ..... 206/219–222, 568; 215/DIG. 8
See application file for complete search history.

(56) References Cited

U.S. PATENT DOCUMENTS 2,694,641 A * 11/1954 Marshall ..... C12C 5/00 206/219
3,326,400 A 6/1967 Hamelin et al.
4,315,570 A * 2/1982 Silver ..... B65D 81/3222 206/221
5,308,922 A * 5/1994 Wallace ..... H01B 3/40 174/87
8,276,748 B2 * 10/2012 Nyambi ..... B65D 51/2835 206/219
2003/0222102 A1 12/2003 Cho
2004/0007481 A1 * 1/2004 Kiser, Jr. ..... B65D 51/2878 206/219

(Continued)

FOREIGN PATENT DOCUMENTS

DE 8624487 U1 1/1988
DE 202006009805 U1 8/2006

OTHER PUBLICATIONS

International Search Report dated Jan. 29, 2016 of corresponding International application No. PCT/ES2015/070349; 5 pgs.

*Primary Examiner* — Luan K Bui
(74) *Attorney, Agent, or Firm* — Maier & Maier, PLLC

(57) ABSTRACT

Mixing stopper, fixed on the neck of a package which includes a capsule for anchoring to the neck of the package, a receptacle containing a product to be mixed with the content of the package, a lid for closing the open base of the receptacle and a spring fitted between the receptacle and the bottom of the capsule.

4 Claims, 3 Drawing Sheets

(56) References Cited

U.S. PATENT DOCUMENTS

| | | | | |
|---|---|---|---|---|
| 2005/0150902 | A1* | 7/2005 | Cho | B65D 51/2892 206/219 |
| 2009/0321285 | A1 | 12/2009 | Enghard | |
| 2010/0219202 | A1* | 9/2010 | Kneer | B05B 15/30 222/83 |

* cited by examiner

MIXING STOPPER

FIELD OF THE INVENTION

The present invention relates to a mixing stopper, in particular conceived for closing bottles or packages which must contain, in a separated manner, two products or substances, the joining and mixing of which should only be carried out at the time the content is consumed or used.

More specifically the cap of the invention is of the type which is provided with means for coupling and fixing to the neck of an externally threaded package, the cap of which bears a product or substance intended to be mixed with another product or substance contained in the package, the package being provided with a threaded cap.

BACKGROUND OF THE INVENTION

The caps of the type indicated are, for example used in packages intended to contain pharmaceutical products, generally composed of a powder substance, contained in the cap and a liquid substance contained in the package, the dissolving of the solid product in the liquid has to be effected at the time of ingestion or consumption.

The caps known for the purpose indicated have the problem of their reduced capacity, not being suitable for other possible purposes in which relatively high quantities of substances are required to be mixed.

(In the case that a cap of this type is known, it must be cited and in particular if a record relating to these types of caps is known).

SUMMARY

The object of the present invention is a mixing stopper, having a high capacity for containing a product, generally in solid state, for example in powder form, intended to be mixed with another product, generally in liquid state, contained in the package, also with a relatively high capacity, for example in the form of a bottle with a threaded neck and cap.

The cap of the invention is composed of a reduced number of pieces, which are coupled to each other in order to be fitted on the bottle at the time the products to be dispensed are packaged.

The cap is composed of four independent pieces: a capsule for anchoring to the neck of the package, a receptacle container for one of the products to be mixed and fitted with a pouring mouth, a lid for closing the receptacle container, and a helical spring responsible for causing the opening of the receptacle.

These four pieces are coupled to each other in order to be fitted on the bottle at the time the products to be contained therein are packaged.

The capsule for anchoring to the neck of the bottle or package has a cup shape, with the bottom perforated and fitted with a central opening, dimensioned for allowing the passage through the same from the receptacle container.

The receptacle is housed axially in the anchoring capsule and has a greater height than said capsule, partially passing through the bottom of the same through its central opening. This receptacle is provided with a pouring mouth which is in the capsule directed downwards.

According to a possible form of execution, receptacles with cylindrical configuration, open through one of their bases, through which they are introduced in the anchoring capsule, the central opening of the bottom of said capsule having a circular contour, with a diameter approximately equal to the exterior of the receptacle.

The lid closes the open base of the receptacle and is provided with two concentric walls, coupled and fixed by way of the internal wall on the open base of said receptacle.

The helical spring is fitted in a compressed manner between the bottom of the capsule and the receptacle container and serves to cause the separation between said receptacle and the closing lid thereof at the time the operation for its opening is effected, as outlined further on.

The capsule is provided externally with lateral pins for the anchoring thereof to the neck of the bottle, pins which project externally from the wall thereof. Furthermore, the capsule is provided externally with axial pins which project from the bottom, in a position adjacent to the edge of the central opening. The closing lid of the receptacle is coupled and fixed on these axial pins, by way of the external wall thereof. Internally the capsule is provided on its wall with axial rails leading from the receptacle, which bear retaining stops for said receptacle. These stops project from the open base of the capsule and are breakable by means of the complete threading of the closing cap of the package.

The receptacle is fitted externally, proceeding from the closed base, with axial guide columns and radial projections matching the guide columns. The columns run along the wall of the receptacle, separated from the same and are coupled on the rails of the capsules. In terms of the radial projections, they are positioned under the retaining stops of the capsule.

The spring is located between the guide columns of the receptacle and the wall of the same, being incorporated between the base of the columns and the bottom of the receptacle.

The guide columns of the receptacle have a greater height than the wall of the capsule and are placed on the free end thereof in an external projection which has a greater contour than that of the passages by way of which the guide columns pass through the bottom of the capsule. This projection projects below the bottom of the capsule at a height which limits the displacement of the receptacle between positions of maximum and minimum penetration into the capsule.

In terms of the retaining stops of the capsule, they consist of pins which project axially from the axial rails and are breakable by the complete threading of the cap of the package. The mentioned pins are provided with a lateral recess opposed to the direction of threading of the cap of the package, in which recesses the radial projections of the closed base of the receptacle are introduced and retained.

BRIEF DESCRIPTION OF THE DRAWINGS

In the attached drawings, a non-limiting exemplary embodiment is shown.

DETAILED DESCRIPTION

Figure 1:
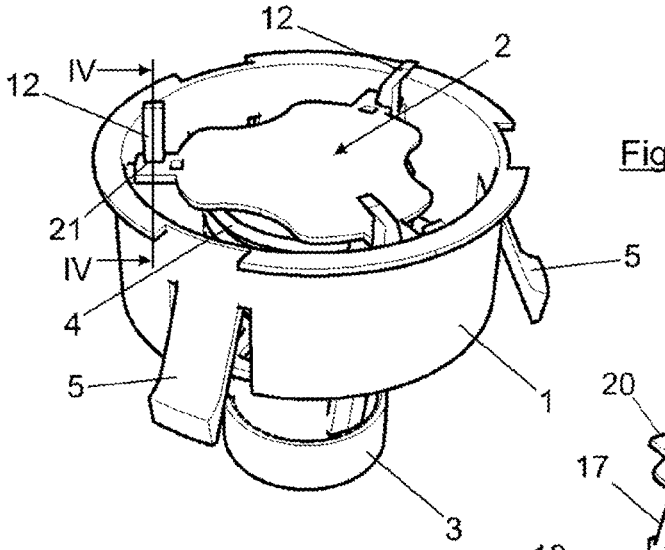
FIG. 1 being a top view of a cap constituted according to the invention.

The cap shown in FIG. 1 is composed of an external capsule (1), a receptacle (2) housed axially inside the capsule and fitted with a pouring mouth, a lid (3) for closing the pouring mouth of the receptacle (2) and a helical spring (4) which is arranged around the receptacle (2), incorporated between the bottom of the capsule and said receptacle.

Figure 2:
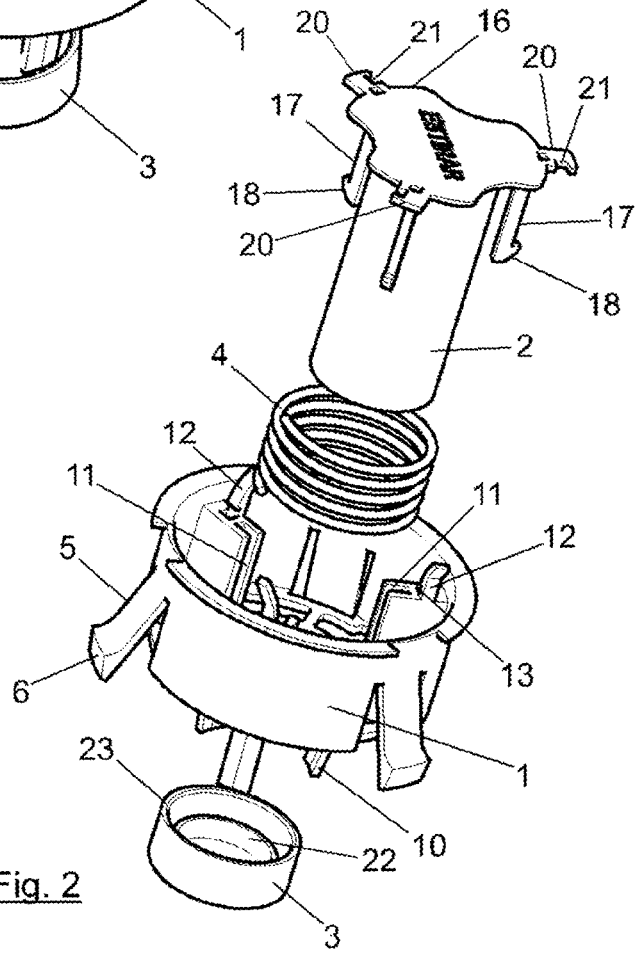
FIG. 2 being an exploded view of the cap from FIG. 1.
Figure 3:
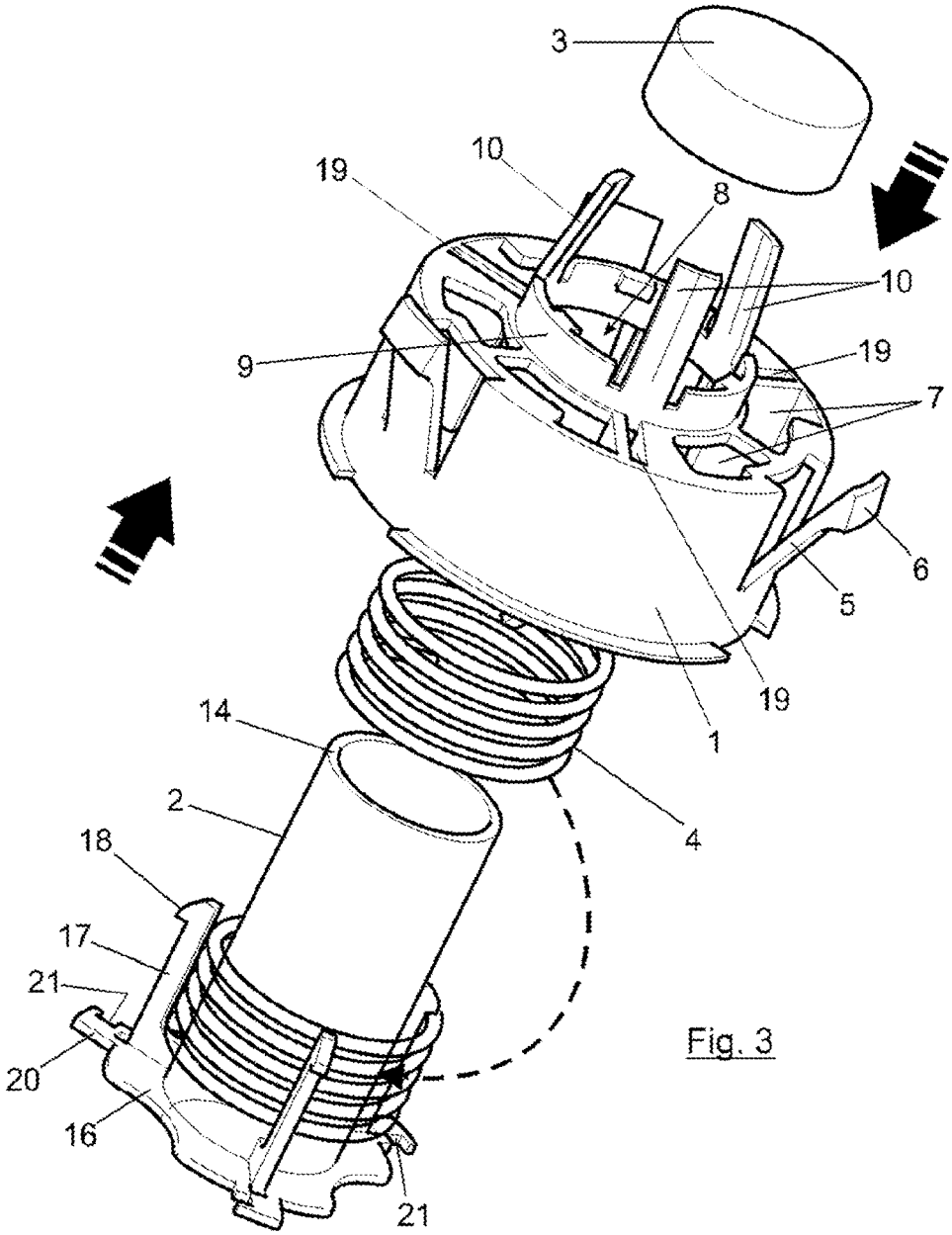
FIG. 3 being a lower exploded view of the same cap.

As can be observed better in FIGS. 2 and 3, the capsule (1) is provided externally with lateral pins (5) obtained from the wall of the capsule, inclined outwards, which are placed in a projection (6) which together serves as an anchoring means for the assembly on the internal surface of the neck of the package or bottle. The capsule has a cylindrical configuration, with a bottom perforated by means of windows (7) and provided with a central opening (8), with a circular contour, surrounded by a wall (9) from which slightly converging axial pins (10) project.

Internally the capsule (1) is provided on its wall with axial rails (11), which bear on their ends retaining stops (12) for the receptacle (2), as is outlined further on. These retaining stops (12) adopt the shape of pins which project with respect to the open base of the capsule (1) and are provided, as can be better observed in FIG. 4, with a lateral recess (13), opposed to the direction of rotation of the cap, when being threaded. The retaining caps (12) are breakable by the cap of the package, when it is completed threaded on the neck of said package.

The receptacle (2) has a cylindrical configuration, which a diameter
approximately equal to the central opening of the bottom of the capsule (1), and has an open base (14) which is closed by means of the lid (3). Around the closed base (15), a peripheral wing (16) projects from which axial guide columns (17) extend which run separated from the wall of the receptacle (2) and end in an external projection (18) in the form of a spear.

The guide columns (17), matching in numbers with the axial rails (11), are positioned for coupling and being able to displace along said rails. Furthermore, these guide columns (17) have a greater height than the capsule (1) and are introducible by way of the opposable passages (19) which exist at the bottom of the capsule (1). The passages (19) have less of a contour than that of the external projections (18) of the guide columns (17).

Figure 4:
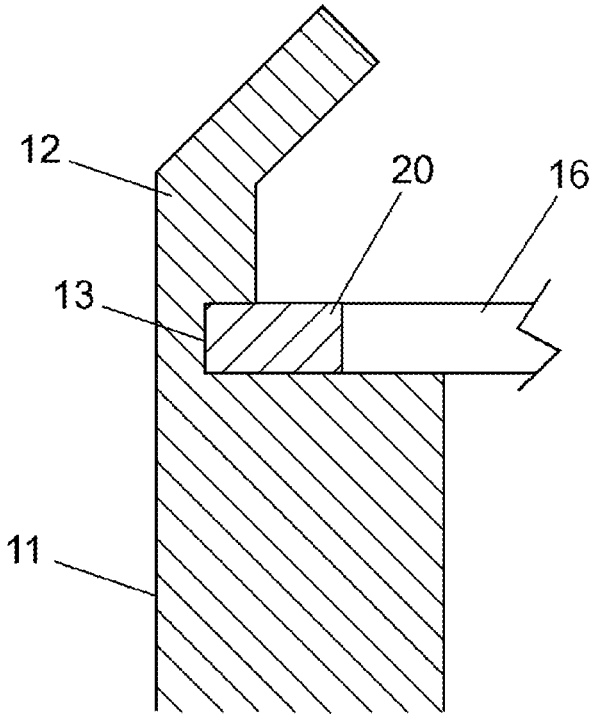
FIG. 4 being a partial section of the cap, taken according to the cut line IV-IV from FIG. 1.

From the peripheral wing (16) radial projections (20) also project with a position matching the guide columns (17), which may be provided with a joint (27) by way of which said radial projections are coupled in the lateral recess (13) of the retaining stops (12) of the capsule, as can be observed in FIGS. 1 and 4.

The spring (4) is arranged between the wall of the receptacle (2) and the columns (17) and is incorporated between the base of said columns and the bottom of the capsule.

The lid (3) is provided with two concentric walls, an internal wall (22) by way of which it is coupled and fixed to the open base (14) of the receptacle (2) and another external wall (23) by way of which it is coupled and fixed to the axial pins (10).

With the constitution described, the functioning of the cap is as follows: proceeding from the filling of the receptacle (2) with the quantity of envisage product, the spring (4) is coupled between the receptacle and guide columns (17) and said receptacle is introduced into the capsule, with the guide column (17) displacing on the guide rails (11) until they project by way of the passages (19) with their external projections (18) until the radial projections (20) are coupled in the lateral recesses (13) of the retaining stops (12), a position in which the spring (4) is compressed and the guide columns (17) project from the bottom of the capsule (1) and the receptacle (2) also projects from the bottom of the capsule (1). In this situation, the open base (14) of the receptacle (2) is closed with the lid (3), and said lid is fixed, by way of its external wall (23) to the axial pins (10), the assembly being as is shown in FIG. 1 in order to be fitted on the neck of the package, on which it is retained by way of the lateral pins (5).

The opening of the cap of the invention is achieved by way of the threaded cap which closes the neck of the package. By means of the complete threading of said threaded cap, the breakage of the retaining stops (12) is produced, a situation in which the spring (4) is released which causes the displacement of the receptacle (2) towards the exterior of the capsule, separating from the lid (3) which is retained by the axial pins (10), a situation in which the content of the receptacle (2) falls into the package or bottle.

The outlet of the receptacle (2) of the capsule (1) is limited by the height of the guide columns (17), when the external projection (18) is retained by the passages (19) of the bottom of the capsule.

The invention claimed is:

1. Mixing cap which couples to the neck of an externally threaded package and which bears the product to be mixed with the content of the package, comprising:

a capsule for anchoring to the neck of the package, in the form of a cup with the bottom perforated and fitted with a central through opening;

a receptacle containing the product to be mixed with the content of the package, which is housed axially in the capsule, partially passing through the central opening of its bottom and it is open through the base introduced by way of the bottom of the capsule and closed by the opposing base;

a lid for closing the open base of the receptacle which is provided with a double concentric wall by way of the innermost wall of which it is coupled to the open base of the receptacle for its closing;

a helical spring which is fitted in a compressed manner between the bottom of the capsule and the receptacle;

the capsule of which is provided externally with lateral pins for anchoring to the neck of the package which project externally from the wall thereof and axial pins which project from the bottom in a position adjacent to the edge of the central opening of the same, on which the lid for closing the receptacle is coupled by way of its external wall, while internally the capsule is provided on its wall with axial rails leading from the receptacle which bear retaining stops for said receptacle and project from the open base of the capsule, being breakable by means of the complete threading of the closing cap of the package;

the receptacle of which is provided externally, proceeding from the closed base, with axial guide columns and radial projections matching said columns, the guide columns of which run along the wall of the receptacle, separated from the same, are coupled to the rails of the capsule and pass through the base of said capsule by way of opposable passages and the radial projections of which are positionable below the retaining stops of the capsule;

the spring of which is located between the guide columns and the wall of the receptacle, incorporated between the base of the guide columns and the bottom of the capsule;

the receptacle being displaceable axially inside the capsule between a position of maximum coupling, in which the open base of said receptacle is coupled and closed via the closing lid and a position of minimum penetration in which said open base is separated from the capsule.

2. Cap according to claim 1, wherein the guide columns have a greater height than the wall of the capsule and are placed on its free end on an external projection which has a greater contour than that of the passages by way of which the guide columns pass through the bottom of the capsule, the projections of which project below the bottom of the capsule at a height which limits the displacement of the receptacle between its positions of maximum and minimum penetration into the capsule.

3. Cap according to claim 1, wherein the receptacle is provided externally, around the closed base thereof, with a peripheral wing from which the guide columns extend and the radial projections project.

4. Cap according to claim 1, wherein the retaining stops of the capsule comprises of pins which project axially from the axial rails, are breakable by the complete threading of the cap of the package and are provided with a lateral recess, opposed to the direction of threading of said cap, in which recesses the radial projections of the closed base of the receptacle are introduced and retained.

* * * * *